1/1/80 AR 4181622

952/100

United States Patent [19]
Gavin
[11] 4,181,622
[45] Jan. 1, 1980

[54] CLEANING COMPOSITION AND METHOD FOR REMOVING MARINE ACCUMULATIONS FROM SURFACES

[76] Inventor: David C. Gavin, 127 Whippoorwill Rd., Brandon, Miss. 39042

[21] Appl. No.: 737,585

[22] Filed: Nov. 1, 1976

[51] Int. Cl.[2] ..... C11D 1/04; C11D 7/50

[52] U.S. Cl. ..... 252/143; 134/3; 134/42; 252/174.25; 252/100; 252/142; 252/170; 252/DIG. 14; 252/174.25

[58] Field of Search ..... 252/136, 142, 143, 144, 252/145, 162, 164, 170, 173, 175, 180, DIG. 14; 134/3, 41, 42; 210/64

[56] References Cited

U.S. PATENT DOCUMENTS

| | | | |
|---|---|---|---|
| 278,176 | 5/1883 | Payne | 252/142 |
| 542,524 | 7/1895 | Hutchinson | 252/142 |
| 1,165,027 | 7/1915 | Seigel et al. | 252/95 |
| 1,428,084 | 9/1922 | Gravell | 252/144 |
| 1,494,147 | 5/1924 | Braun | 252/143 |
| 1,765,331 | 6/1930 | Gravell | 252/143 |
| 1,809,970 | 6/1931 | Holland | 252/143 |
| 1,892,093 | 12/1932 | Battistella | 134/22 |
| 1,949,921 | 3/1934 | Schweitzer | 148/8 |
| 2,245,052 | 6/1941 | Salz | 252/143 |
| 2,399,134 | 4/1946 | Miller et al. | 252/143 |
| 2,529,549 | 11/1950 | Halpern | 134/6 |
| 2,631,950 | 3/1953 | Rosenfeld et al. | 134/3 |
| 2,672,449 | 3/1954 | Snell et al. | 252/100 |
| 3,166,444 | 1/1965 | Ehren et al. | 134/3 |
| 3,214,380 | 10/1965 | Gangwisch | 252/100 |
| 3,374,116 | 3/1968 | Fetters | 134/2 |
| 3,553,016 | 1/1971 | Foelsch | 134/3 |
| 3,650,964 | 3/1972 | Sedilar et al. | 252/106 |
| 3,652,420 | 3/1972 | Hill | 252/101 |
| 4,030,440 | 6/1977 | Wickersham | 114/222 |

FOREIGN PATENT DOCUMENTS

| | | |
|---|---|---|
| 122023 | 8/1927 | Switzerland . |
| 543458 | 2/1942 | United Kingdom . |
| 812745 | 4/1959 | United Kingdom . |
| 2589 | 10/1965 | United Kingdom . |

*Primary Examiner*—P. E. Willis, Jr.
*Attorney, Agent, or Firm*—Sigalos & Levine

[57] ABSTRACT

This invention relates to a composition for removal of algae, marine residue, marine vegetation, and stains on surfaces and resulting from the immersion of such surfaces in natural bodies of water comprising from about 5 to 20 parts by weight of an acid selected from oxalic, citric, phosphoric, or mixtures thereof dissolved in a solution comprising from about 10 to 20 parts by weight of a $C_1$ to $C_3$ alkanol and 80 to 90 parts by weight of water and to the method of cleaning such surfaces utilizing said composition.

12 Claims, No Drawings

CLEANING COMPOSITION AND METHOD FOR REMOVING MARINE ACCUMULATIONS FROM SURFACES

BACKGROUND OF THE INVENTION

Methods currently in use for the removal of accumulations of algae, marine residue, marine vegetation (hereinafter referred to as "marine accumulations") and stain from objects and surfaces such as boat hulls, which have been immersed in natural bodies of water, such as rivers, lakes, oceans, and the like, for periods of time, fall into two categories; scouring pads/powders or rubbing compounds, and solutions containing strong acids. These both have serious drawbacks.

The methods employing scouring action for stain removal are very expensive in terms of time and labor (one to two full days are required to clean an average 16 to 18 foot boat), but more important is the fact that the scouring action permanently damages the finish of the surface being cleaned by scratching the same. The resulting minute scratches in the finish accelerate the accumulation of algae, marine residue, marine vegetation and stain when the surface is reimmersed in water. The methods employing harsh acids such as hydrochloric, nitric or carbolic will remove algae, marine residue and marine vegetation, but will not remove the stain. However, they are dangerous to use and can cause serious damage to painted surfaces. In addition, they can and do damage the painted surfaces and trim of boat trailers and/or outdrive units due to spilling or dripping of the cleaner during the cleaning process.

As a result, the cleaning of boat hulls is an arduous and time-consuming task vexing boat owners, yet one which must be carried out periodically to properly maintain the craft.

SUMMARY OF THE INVENTION

The present invention provides a novel method employing a novel cleaning composition for the safe, non-scouring, extremely rapid acting removal of marine accumulations and stains from surfaces.

Briefly stated, the present invention comprises a composition for removal of marine accumulations and stains from surfaces comprising from about 5 to 20 parts by weight of an acid selected from oxalic, citric, phosphoric, or mixtures thereof dissolved in a solution comprising from about 10 to 20 parts by weight of a $C_1$ to $C_3$ alkanol and about 80 to 90 parts by weight of water. The invention also comprises the method for cleaning marine accumulation and stains from such surfaces as more fully described herein.

DETAILED DESCRIPTION

While the instant invention is applicable to the cleaning of any surface to remove marine accumulations and stains, it has particular application to the cleaning of boat hulls and will be described in connection therewith.

As to the composition, there are three essential components that must be present in certain specified proportions. The components are an acid, a $C_1$ to $C_3$ alkanol, and water. Optionally, a gelling agent may be added to the composition.

The acid used is selected from oxalic, citric, phosphoric, or mixtures thereof with oxalic acid being preferred. Phosphoric acid is least preferred in that, even at high concentrations, it does not operate as rapidly as oxalic acid at lower concentrations and the phosphoric acid can be hazardous in high concentrations to persons, clothing, and painted surfaces if carelessly used. Compositions using citric acid are much slower acting than those employing oxalic or phosphoric acid and may not be desired by those requiring a rapid cleaning action. Oxalic acid, because of its surprisingly rapid action at even low concentrations and because of the fact that, even at very high concentrations (saturation in alkanol and water), it will not harm normal skin, most fabrics, or painted surfaces, is the preferred acid.

Rapidity of cleaning action and safety for the user, his clothing, and the boat surfaces (hull, trim, and the like), are extremely important since, with boat hulls, a significant amount of the cleaning is done with the surface being cleaned suspended above the individual doing the cleaning. As a consequence, some of the composition, in the form of a mist or drops, could rain upon the user, his clothing, or other portions of the boat.

With respect to the alkanol, it must be a $C_1$ to $C_3$ alkanol such as methanol, ethanol, propanol, and isopropanol or mixtures thereof. From the viewpoint of safety, efficacy, and freedom from Federal regulation, isopropanol is preferred. Ethanol, though safest from a human exposure viewpoint, is not preferred for use due to the stringent Government regulations covering its manufacture, use, and sale in all forms. Equally important is the fact that the denaturants commonly used in ethanol, such as aviation gasoline, tended to detract from the safety and effectiveness of the instant composition. Methanol, though safest from an explosiveness viewpoint, is not preferred for use in the present method due to its toxicity and resulting low allowable human exposure limits of 200 PPM or 260 $Mg/M^3$. With propanol and isopropanol, the latter is preferred for use in the present invention because of its higher allowable human exposure limits of 400 PPM or 980 $Mg/M^3$. Isopropanol has a vapor pressure at one atmosphere approaching that of water which gives it a desirable rate of evaporation in the present method and it is miscible with water.

Oxalic acid is very soluble in the $C_1$ to $C_3$ alkanols and their use in combination with water provides a higher concentration of oxalic acid in solution than is attainable through the use of an aqueous solution alone or in combination with a solvent in which oxalic acid is soluble to a lesser degree or insoluble. A further advantage of isopropanol from a safety standpoint is that its comparatively sharp, acrid odor would tend to minimize the danger of accidental ingestion or prolonged inhalation.

Table I below shows a comparison of physical properties of various solutions of isopropyl alcohol, water, and oxalic acid, the preferred composition:

TABLE I

| Parts by Weight Alkanol-Water-Acid | Begin Precipitation of Acid °F. (Approx.) | Evaporation Time (Mins.) (Approx.) |
|---|---|---|
| 10-90-5 | 27 | 35 |
| 10-90-10 | 43 | 33 |
| 10-90-15 | 55 | 30 |
| 10-90-20 | 68 | 20 |
| 15-85-5 | 21 | 32 |
| 15-85-10 | 41 | 30 |
| 15-85-15 | 52 | 25 |
| 15-85-20 | 66 | 16 |
| 20-80-5 | 17 | 26 |
| 20-80-10 | 39 | 20 |
| 20-80-15 | 50 | 15 |
| 20-80-20 | 64 | 13 |

The above testing was conducted in non-laboratory environment and figures are valid for comparison only between the various compositions. The Evaporation Time was determined by measuring the time required for a drop of solution to evaporate when placed on a flat, non-porous, surface at a temperature of 76° F. and approximately 60 to 70% relative humidity.

With respect to proportions, the composition should comprise from about 5 to 20 parts by weight of acid dissolved in a solution comprising 10 to 20 parts by weight of alkanol and 80 to 90 parts by weight of water.

A composition containing less than 5 parts by weight oxalic acid dissolved in 100 parts by weight of solution produces action times at low temperatures which are not considered preferable for a commercially successful method. One of the significant advantages of the present method is its rapidity of action and the resulting savings in time and labor. A concentration of greater than 20 parts by weight oxalic acid dissolved in 100 parts by weight (20 alcohol/80 water) solution will not remain in solution below a temperature of approximately 65° F. and produces significantly reduced drying times. A composition containing less than 10 parts by weight isopropyl alcohol to 90 parts by weight water does not consistently produce an acceptably rapid and complete penetration and wetting of heavy accumulations of algae, marine residue, and marine vegetation, particularly at the waterline where the accumulation frequently contains oil and grease. A concentration of greater than 20 parts by weight isopropyl alcohol to 80 parts by weight water results in unacceptably short drying times at higher temperatures, especially on vertical surfaces.

As noted above, addition of a gelling agent to the composition is optional. Any gelling agent compatible with the other components can be used with silicon dioxide (CAB-O-SIL) being illustrative and preferred. If used, the gelling agent can be used in various proportions depending upon the degree of thickening desired. Ordinarily, an amount of silicon dioxide ranging from about 5 to 15% by weight of the composition can be used.

Preparation of the compositions is accomplished by simply adding the alkanol to the water and then adding the acid. Dissolution of the acid in the case of oxalic acid may be accelerated by heating the composition to 90° to 100° F. and by shaking or stirring.

If the silicon dioxide is to be added as a thickener, the desired proportion is determined and then gradually added to the basic composition while stirring as with an electric mixer after the desired amount has been added, mixing should be continued for an additional period, 10 to 20 minutes, to ensure thorough incorporation. Preliminary tests indicate that a 5% by weight addition of silicon dioxide but slightly thickens the composition and it remains rather thin and flows readily while a 15% addition which has been allowed to stand overnight has a consistency approaching that of jelly.

The method of cleaning boat hulls (or other surfaces) to rid them of marine accumulations and stains comprises applying the composition and permitting it to remain on the hulls for a time sufficient to remove the stain and debond the marine accumulations, and then removing the composition from the hulls together with the marine accumulations and stains. In the case of hulls heavily fouled with marine accumulations, it is desirable to agitate the accumulation on the hulls prior to removal.

The compositions can be applied at any temperature above freezing and over any range of humidity. They are applied to the surface to be cleaned by any method, as by the use of a brush, mop, paint roller, or by the use of spraying apparatus. It is preferred that the surface to be cleaned be removed from the water and allowed to dry before cleaning proceeds.

After application, the composition is permitted to remain on the surface for a time sufficient to debond the marine accumulations and remove the stain. Ordinarily, such time will be about 1 to 5 minutes, dependent largely on the particular constituents in the composition.

If marine accumulation is present, it is then agitated as with a stiff brush and, as a final step, the accumulation, stain, and composition removed from the surface. The removal is most expeditiously effected by simply applying a stream of water over the surface to wash off the materials, although removal can also be accomplished by using a wet cloth, mop, brush or the like.

For purposes of illustration, Table II below sets forth a comparison of the action times of various amounts of oxalic acid in a solution consisting of 20 parts by weight isopropanol and 80 parts by weight water used to clean the hull of a boat.

TABLE II

| Parts of Acid Dissolved in 100 Parts of Solution | Stain Removal (Sec.) | Debond Algae and Marine Residue (Sec.) | Debond Marine Vegetation (Sec.) |
|---|---|---|---|
| 5 | 6 or less | 10 or less | 40 or less |
| 10 | 5 or less | 9 or less | 30 or less |
| 15 | 4 or less | 8 or less | 25 or less |
| 20 | 3 or less | 7 or less | 20 or less |

The tests were conducted on vertical portions of a white fiberglass boat. The boat was new when placed in water and gelcoat finish had not been damaged by previous cleaning with scouring cleansers. Boat had been in the water for approximately two years, and portions below the waterline were stained coffee brown and coated with algae, marine residue, and marine vegetation. Boat had been allowed to dry for four days prior to tests. Tests were conducted in an environment of 86° F., 60% relative humidity, light winds, and test surface was in direct sunlight. Since action time and drying time are temperature and humidity dependent, these figures are valid for comparison only.

As can be seen from the above tables, the preferred cleaning composition for use in the present method can be tailored for maximum effectiveness over a broad spectrum of temperature and humidity conditions.

In the present method, accumulations of dry algae, marine residue, and marine vegetation on the surface being cleaned act to absorb the cleaning composition, retard evaporation, and maintain the composition in contact with the surface during the required action time. If the accumulation is not present, and only the stain required removal, a gelling agent may be necessary in the composition to accomplish the necessary contact time.

Summarizing, the present method for safe, extremely rapid removal of accumulations of algae, marine residue, marine vegetation and stain from surfaces which have been submerged for periods of time consists of the following:

A. If accumulation is present:

1. Remove object from water and allow surface to thoroughly dry.
2. Apply the preferred present cleaning composition using a brush, spraying apparatus, or the like.
3. Allow composition to act for approximately 1 to 5 minutes.
4. Agitate algae, residue and vegetation with a stiff brush.
5. Hose off with water.

B. If all accumulations have been previously removed and only stain is present:

1. Allow surface to dry.
2. Apply the thickened preferred present cleaning composition using a brush, mop or paint roller.
3. Allow composition to act until drying is observed (dependent upon thickness and/or atmospheric conditions); about 1 to 5 minutes.
4. Hose off with water.

As is noted above, solutions containing water, alkanol and phosphoric acid or citric acid will also operate in the present method, though at a considerably slower rate than the preferred water, alkanol, oxalic acid composition. The following example illustrates this comparison.

EXAMPLE 1

Three solutions, composed of the following ingredients, were prepared.

| Solution No. 1 | Solution No. 2 | Solution No. 3 |
|---|---|---|
| 20% by weight phosphoric acid | 10% by weight phosphoric acid | 10% by weight oxalic acid |
| 10% by volume isopropyl alcohol | 3% by weight oxalic acid | 10% by volume isopropyl alcohol |
| 90% by volume water | 10% by volume isopropyl alcohol | 90% by volume water |
| 10% by weight CAB-O-SIL | 90% by volume water | |
| | 5% by weight CAB-O-SIL | |

The test surface was the hull of a white fiberglass boat which had been in wet storage for approximately 18 months. The boat was new when placed in the water and had not been previously cleaned with scouring materials. The portion of the boat which had been submerged was coated with algae, marine residue, and marine vegetation and gelcoat finish was permanently stained. The boat had been removed from the water two days prior to the test and coating was hard and dry.

Each of the above solutions was applied to a separate area of the test surface to determine comparative rate of debonding of coating and stain removal. Debonding and stain removal was noted in area treated with Solution No. 3 within approximately 1 to 2 minutes; in area treated with Solution No. 2 within approximately 10 to 15 minutes; and in area treated with Solution No. 1 within approximately 20 to 25 minutes.

The following examples illustrate the best presently known mode of carrying out the present method using the preferred cleaning composition and are set forth for purposes of illustration only.

EXAMPLE 2

A solution was prepared which contained 10 parts by weight oxalic acid, 10 parts by weight isopropyl alcohol, and 90 parts by weight water. A thickened modification was also prepared by adding 5 parts by weight CAB-O-SIL to the above solution. The test surfaces were the hull of an 18 foot, green fiberglass boat and a white outdrive unit. The boat had been in wet storage for approximately seven months each year and had then been placed in dry storage, without cleaning, for the remaining five months of the year for at least three consecutive years. The accumulation of algae, marine residue, marine vegetation and stain was so severe that portions which had been submerged appeared to have been painted black. During the test, close inspection revealed that the gelcoat finish of the fiberglass had been damaged by a previous cleaning with scouring materials or rubbing compound. The resulting minute scratches had accelerated permanent staining and accumulation of algae, marine residue and marine vegetation.

The unthickened cleaning composition was applied to the dry accumulation with an ordinary garden sprayer. After allowing approximately 5 minutes for the composition to act, the loosened accumulation was agitated with a nylon brush and then hosed off. The surface was then allowed to dry and the cleaning composition was reapplied on any areas which had not been completely cleaned by the first application. Due to the severity of the stain and accumulation on this particular boat (which is considered an extreme case, boats are normally cleaned annually), it is estimated that cleaning time, including the outdrive unit, using the present method, was approximately three hours. The operator of the marina at which this test was conducted estimated that it would require two full days to clean this boat by the commonly used methods.

EXAMPLE 3

During the test in Example 2, the owner of an 18 foot fiberglass boat located adjacent to the test boat was attempting to remove permanent stain (accumulations had been previously removed by scrubbing with a brush—4 hours labor) from the hull of his boat with rubbing compound and an electric buffer. He had been working on it for approximately six hours with little success, and gladly accepted an offer to participate in testing of the present method. He applied the thickened modification of the cleaning composition, set forth in Example 2, to the stained surfaces of the boat with a paint roller (application time approximately 10 minutes), allowed the composition to remain for approximately 10 to 15 minutes, and then hosed it off. All stains were completely removed.

EXAMPLE 4

A solution was prepared which contained 12.5 parts by weight oxalic acid, 12 parts by weight isopropyl alcohol, and 88 parts by weight water. A thickened modification was also prepared by adding 7 parts by weight CAB-O-SIL to the above solution. The test surface was the hull of a 24 foot white fiberglass sailboat. The boat was approximately 4 years old, had been in wet storage for approximately 12 months and was only moderately stained and residue coated. Scratches in the gelcoat finish indicated that the boat had been previously cleaned with scouring materials or rubbing compound. Due to the relative lightness of the accumulation, it could be completely removed by light agitation with a brush and hosing off within 1 minute after spray application of the unthickened composition. As a result, it was decided to remove the accumulation first (total time approximately 30 minutes to include jacking up each end of boat in order to clean portions resting on trailer pads) and then applying the thickened composition to remove any remaining stain from the scratches in the gelcoat finish. Application time (with a paint roller) for the thickened composition was approximately 15 minutes and composition was allowed to act for approximately 15 minutes before hosing off. Total time required for one man to remove all accumulation and stain from this boat using the present method (to include jacking and allowing to dry between applications), was approximately 1½ hours.

EXAMPLE 5

A solution was prepared which contained 15 parts by weight oxalic acid, 15 parts by weight isopropyl alcohol, and 85 parts by weight water. The test surfaces were the hull and outdrive unit of a 25 foot white fiberglass boat which had been in wet storage for approximately 2 years. The boat was new when placed in the water and had not been previously cleaned with scouring materials. The portion of the boat which had been submerged was heavily coated with an accumulation of algae, marine residue, and marine vegetation and gelcoat finish was permanently stained. The boat had been removed from the water four days prior to the test and coating was hard and dry. The composition was applied to successive 3×4 foot areas of the test surface. As the stain was removed (3 to 7 seconds) and accumulation debonded (5 to 10 seconds for algae and marine residue, 20 to 30 seconds for marine vegetation), the accumulation was agitated with a brush and the treated area hosed off. Total time required for one man to remove all accumulation and stain from this boat including outdrive unit was approximately 2 hours.

It will be appreciated that, although the preferred cleaning composition for use in the present method is considered harmless to most clothing, it may tend to bleach dyes if allowed to remain for extended periods. It is also considered harmless to normal skin, however, extremely sensitive skin may be irritated by prolonged exposure. Eye protection should be used during application and all operations should be carried out in well ventilated areas to prevent excessive inhalation of mist or vapors of the composition.

While the invention has been specifically described in its preferred embodiments as applying the cleaning composition to the surface being treated by spraying, brushing, mopping, rolling, etc., it is to be included in the scope of the present method to immerse the surface being treated in the cleaning composition.

It will be evident that other components, such as colorants, odorants, and the like can be added to the composition in the usual amounts and for their usual purposes, so long as they do not interfere with the activity of the essential components discussed above.

While the invention has been described in connection with the preferred embodiments, it is not intended to limit the invention to the particular forms set forth, but, on the contrary, it is intended to cover such alternatives, modifications, and equivalents as may be included within the spirit and scope of the invention as defined by the appended claims.

What is claimed is:

1. A composition for removal of marine accumulations and stains from surfaces consisting essentially of from about 5 to 20 parts by weight of oxalic acid dissolved in a solution comprising from about 10 to 20 parts by weight of a $C_1$ to $C_3$ alkanol and about 80 to 90 parts by weight of water.

2. The composition of claim 1 including a gelling agent compatible with the other components of the composition in an amount sufficient to thicken the composition.

3. The composition of claim 2 wherein the alkanol is selected from methanol, ethanol, propanol, isopropanol, and mixtures thereof and the gelling agent is silicon dioxide.

4. The composition of claim 1 wherein the alkanol is isopropanol.

5. A process for cleaning marine accumulations and stains from a surface comprising applying the composition of claim 1 to said surface and permitting it to remain thereon for a time sufficient to remove the stain and debond the marine accumulations from said surface, and then removing said composition from said surface together with the marine accumulations and stains.

6. The process of claim 5 wherein the composition includes a gelling agent compatible with the other components of the composition in an amount sufficient to thicken the composition.

7. The process of claim 6 wherein the alkanol in the composition is selected from methanol, ethanol, propanol, isopropanol, and mixtures thereof and the gelling agent is silicon dioxide.

8. The process of claim 5 wherein the acid in the composition is oxalic acid and the alkanol is isopropanol and the surface is a boat hull.

9. The process of claim 8 including a gelling agent compatible with the other components of the composition in an amount sufficient to thicken the composition.

10. A composition for removal of marine accumulations and stains from surfaces consisting of 5 to 20 parts by weight of oxalic acid dissolved in a solution comprising from about 10 to 20 parts by weight of isopropanol and about 80 to 90 parts by weight water.

11. The composition of claim 10 including a gelling agent compatible with oxalic acid, isopropanol and water.

12. The composition of claim 10 wherein the gelling agent is silicon dioxide.

* * * * *